US007257934B2

(12) United States Patent
Swift et al.

(10) Patent No.: US 7,257,934 B2
(45) Date of Patent: Aug. 21, 2007

(54) BANDING MACHINE

(76) Inventors: Roland Swift, P.O. Box 1243, Westport, Briar Island, Nova Scotia (CA) B0V 1H0; Clifford Morrison, 13 Lorway Drive, Dartmouth, Nova Scotia (CA) B2X 2L1; Kenney Graham, P.O. Box 1246, Westport, Briar Island, Nova Scotia (CA) B0V 1H0

( * ) Notice: Subject to any disclaimer, the term of this patent is extended or adjusted under 35 U.S.C. 154(b) by 0 days.

(21) Appl. No.: 11/054,751

(22) Filed: Feb. 9, 2005

(65) Prior Publication Data

US 2005/0172575 A1 Aug. 11, 2005

Related U.S. Application Data

(60) Provisional application No. 60/542,862, filed on Feb. 10, 2004.

(51) Int. Cl.
*B65B 13/02* (2006.01)
*B65B 13/30* (2006.01)

(52) U.S. Cl. ..... 53/399; 53/585; 100/9

(58) Field of Classification Search ..... 53/399, 53/441, 582, 585, 556; 100/9; 156/571; 426/106

See application file for complete search history.

(56) References Cited

U.S. PATENT DOCUMENTS

| | | | | |
|---|---|---|---|---|
| 1,997,711 | A | 4/1935 | Barwood | |
| 2,009,546 | A | 7/1935 | Fannen et al. | |
| 2,108,327 | A | 2/1938 | Barwood | |
| 2,136,484 | A | 11/1938 | Barwood | |
| 2,138,651 | A | 11/1938 | Barwood | |
| 2,236,936 | A | 4/1941 | Camp | |
| 3,186,333 | A * | 6/1965 | Hoffman et al. | 100/9 |
| 3,386,371 | A | 6/1968 | Farmer et al. | |
| 3,968,710 | A | 7/1976 | Gros | |
| 4,060,015 | A | 11/1977 | Gros | |
| 4,127,978 | A | 12/1978 | Lucke | |
| 4,243,466 | A * | 1/1981 | Lindee | 156/363 |
| 4,262,944 | A * | 4/1981 | Branch | 289/2 |
| 4,387,553 | A * | 6/1983 | Strub et al. | 53/585 |
| 4,442,765 | A | 4/1984 | Limehouse et al. | |
| 4,446,616 | A * | 5/1984 | Waterman | 29/775 |
| 4,470,241 | A | 9/1984 | Parry et al. | |

(Continued)

FOREIGN PATENT DOCUMENTS

| | | |
|---|---|---|
| CA | 350508 | 5/1935 |

(Continued)

*Primary Examiner*—Sameh H. Tawfik
*Assistant Examiner*—Paul Durand
(74) *Attorney, Agent, or Firm*—Kenyon & Kenyon LLP

(57) ABSTRACT

A banding machine is useful for applying rubber bands on lobster claws, grocery bunches or other plural articles in need of bunching together. The machine has a pivotable sub-frame with two pairs of side-by-side fingers. The fingers in each pair are operable to move apart from the adjacent finger to spread a rubber band when placed on the fingers. The machine has two reels of a rubber tube stock and two pairs of grippers to safeguard controlled feed of the tube to band cutters. The fingers are each designed to facilitate disengagement of the rubber bands from the fingers when the fingers are spread i.e. in a band application position and an object, e.g. lobster claw, is placed between spread fingers of a finger pair.

14 Claims, 5 Drawing Sheets

U.S. PATENT DOCUMENTS

| | | | | | |
|---|---|---|---|---|---|
| 4,480,536 | A | | 11/1984 | Burns | |
| 4,514,966 | A | * | 5/1985 | Konstantin | 53/585 |
| 4,519,178 | A | | 5/1985 | Crabb, Jr. | |
| 4,570,415 | A | * | 2/1986 | Centeno | 53/399 |
| 4,579,027 | A | | 4/1986 | Lewis | |
| 4,601,155 | A | | 7/1986 | Lewis | |
| 4,601,156 | A | | 7/1986 | Parry et al. | |
| 4,674,270 | A | * | 6/1987 | Tonus | 53/556 |
| 4,794,832 | A | | 1/1989 | Trimble | |
| 4,829,750 | A | | 5/1989 | Cassidy | |
| 4,881,868 | A | * | 11/1989 | Alameda et al. | 414/773 |
| 5,588,278 | A | | 12/1996 | Wynn et al. | |
| 5,921,060 | A | * | 7/1999 | Straeter | 53/176 |

FOREIGN PATENT DOCUMENTS

| | | |
|---|---|---|
| CA | 360289 | 9/1936 |
| CA | 365731 | 4/1937 |
| CA | 978036 | 11/1975 |
| CA | 1230815 | 12/1987 |
| CA | 1251389 | 3/1989 |
| CA | 2236997 | 7/2000 |
| CA | 2431734 | 12/2004 |

* cited by examiner

BANDING MACHINE

This application claims priority of U.S. provisional application No. 60/542,862 filed Feb. 10, 2004.

TECHNICAL FIELD

This invention relates to a machine for applying elastic bands onto objects to be held together or immobilized, such as lobster claws, produce bunches, firewood and the like.

BACKGROUND ART

It is known that live lobsters are aggressive creatures that must be prevented from attacking adjacent lobsters or even injuring themselves during transportation or when held in a live-lobster tank. It is common practice to apply a rubber band onto the claws of a live lobster. Various devices have been proposed to accelerate and automate this procedure, and exemplary patent literature is listed below.

It is also known to bunch certain produce, e.g. broccoli, by applying elastic bands onto several broccoli stems and then usually cut the excess stems or stalks to a desired length.

In certain instances, lobsters with immobilized claws are held in cold water for an extended period of time. This scenario calls for a band material that is cold-water resistant, unlike in the case of produce bunching. Apart from the above aspect, it is usually quite important not to damage or injure a live lobster as it may cause a deterioration of its consumption value. Vegetable stems are usually less prone to a critical damage during banding. It is therefore of importance to design a lobster claw banding device or machine that provides a degree of safety in this regard.

U.S. Pat. Nos. 4,570,415 to Centeno; 4,480,536 to Burns; 4,470,241 to Parry et al.; and 3,386,371 issued to Farmer et al. are exemplary of machines for bunching produce or vegetables, e.g. broccoli or bananas.

Exemplary devices or machines for banding lobster claws are described in the Canadian Patent 978,036 to Dickie and U.S. Pat. No. 2,009,546 to Fannen et al. U.S. Pat. Nos. 3,968,710 and 4,060,015 to Gros relate to apparatus and method for making resilient bands, and Canadian Patent Application No. 2,431,734 describes a lobster claw retainer made of a cold water-resistant composition.

Canadian Patent 1,251,389 addresses the problem of bonding of elastic bands during cutting.

It is preferable to use a machine that combines the step of making of resilient bands from a tubular elastic band stock with the step of banding. Attempts have also been made in the prior art to safeguard the operator from accidental injury during the cutting of the stock.

SUMMARY OF THE INVENTION

According to one aspect of the invention, there is provided a machine for applying an elastic band on an object, the machine comprising:

a frame, a sub-frame mounted to said frame and comprising at least one pair of fingers mounted side-by-side on said sub-frame and having distal free ends, the fingers movable towards and away from each other along a first axis and their free ends extending transversely to the first axis, spreading means operatively associated with the fingers for selectively moving the fingers towards or away from each other along the first axis, and means for displacing the sub-frame with the fingers between a band reception position and band application position.

In an embodiment of the invention, the displacing means are pivoting means for pivoting the sub-frame between the band reception position and the band application position.

In an embodiment of the invention, the free ends extend in a parallel arrangement substantially perpendicular to the first axis.

In an embodiment of the invention, the machine also comprises a band dispensing mechanism comprising a supply of elastic bands, the supply disposed so that in the band reception position, the distal free ends of the fingers are adjacent to each other and disposed to receive an elastic band from the supply.

The supply of the bands may comprise a source of a tubular band stock and means for separating the tubular band stock into single bands.

In an embodiment of the invention, the supply of bands is disposed above the first axis such that in the band reception position, the free ends of the fingers point angularly or vertically upwards.

In an embodiment of the position, the sub-frame comprises two pairs of the fingers, and in each such pair, one finger is stationary relative to the first axis while the other finger is movable by the spreading means.

The machine may include band disengagement means. Such means may preferably be associate with each pair of the fingers. In an embodiment of the invention, each finger in the pair of fingers comprises a band stretching member and a band push-off member mounted adjacent to the band stretching member and slidable relative to the stretching member parallel to the longitudinal axis of each respective finger, and push-off means for moving the push-off member parallel to the longitudinal axis of the respective finger.

According to another aspect of the invention, there is provided a machine for applying an elastic band to an object, the machine comprising a frame, at least one pair of fingers mounted on the frame and extending thereof side-by side for receiving an elastic band thereon;

means for displacing the fingers of the pair relative to each other between a band spreading position and a retracted position, and means for displacing the pair of fingers between a band reception position and a band application position.

The machine may further comprise band disengagement means for disengaging the band from the pair of fingers in the band application position.

According to another aspect of the invention, there is provided a method for applying elastic bands on objects, the method comprising the steps of:

providing a source of elastic bands, providing at least one pair of fingers movable away from and toward each other and movable between a band reception position and a band application position, placing a band on said at least one pair of fingers in a band reception position, moving the fingers away from each other to spread and to stretch the band, moving the spread fingers to the band application position, positioning an object to be banded within a perimeter of the stretched band, and releasing the band from the fingers onto the object.

BRIEF DESCRIPTION OF THE DRAWINGS

The invention will be described in more detail by way of the following description in conjunction with the drawings, in which.

DESCRIPTION OF THE BEST MODE OF CARRYING OUT THE INVENTION

While the following description is directed to a lobster claw banding machine, it will be understood that the machine is applicable to any other object such as a bundle of firewood, a bunch of vegetables, a roll of paper etc subject only to the dimensions of the machine and particularly the band-applying fingers.

Figure 1:
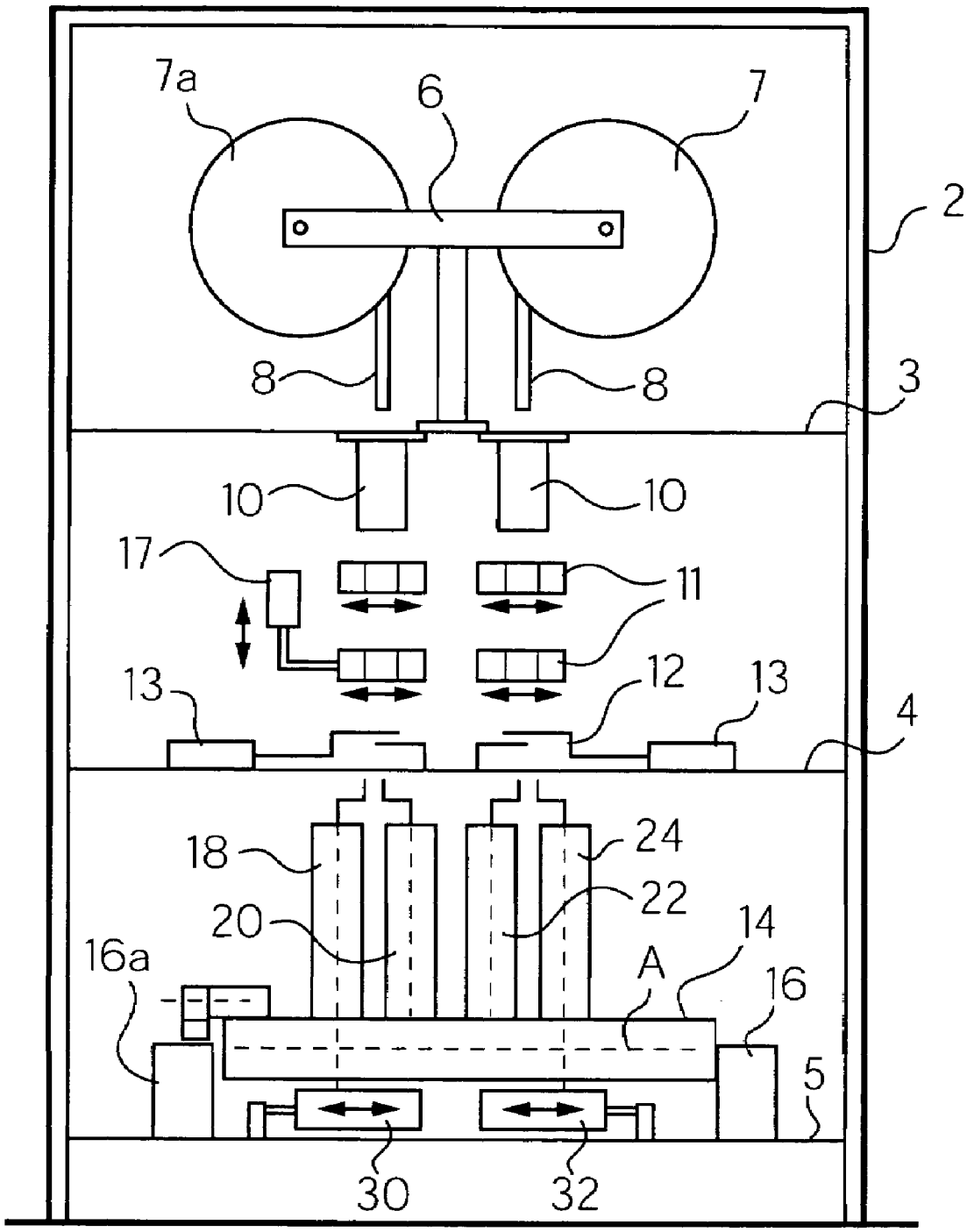
FIG. 1 is a simplified front view of an embodiment of the machine of the invention, with the fingers in a band reception position.

As generally shown in FIG. 1, the machine has a cabinet-shaped frame 2 with three shelves 3, 4 and 5. A band dispensing assembly is mounted on the top shelf 3. The assembly has a roll holder 6 to which are rotatably mounted two spools 7, 7*a* with rubber hoses shown schematically at 8. The hose from each spool is passed through a hole (not shown) in the top shelf 3, through a tubular hose guide or feeder 10 which is mounted to the bottom of the shelf 3, through a pair of grippers 11 and into a band cutter 12 which is mounted underneath the guide 10 and the grippers 11 on the shelf 4. Each cutter 12 is actuated by a pneumatic cylinder 13. The details of the grippers will be explained herein below.

Figure 2:
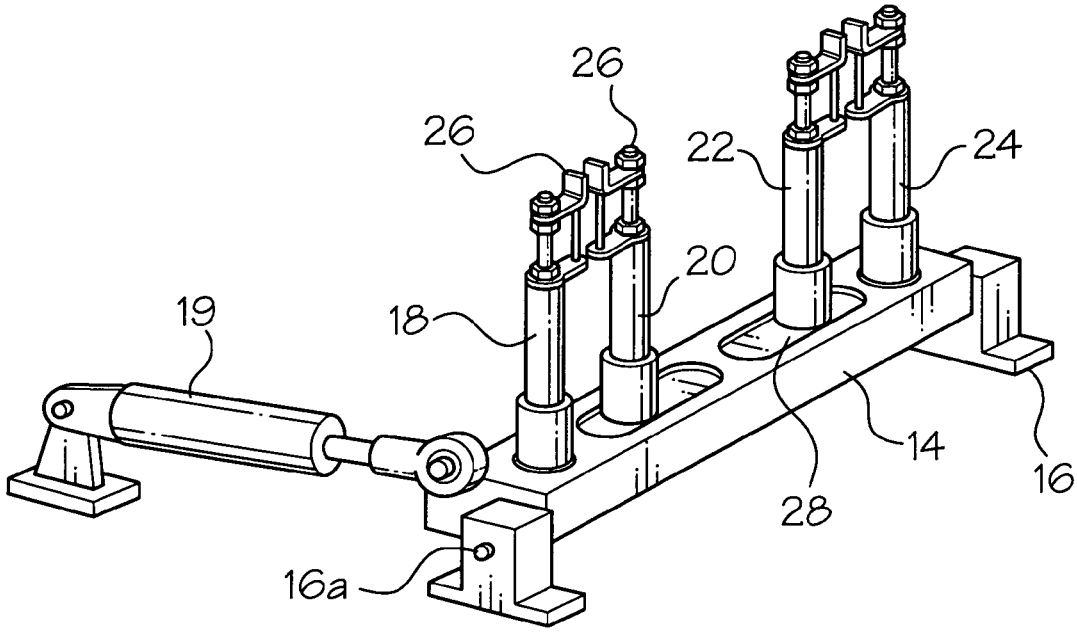
FIG. 2 is a perspective view of a finger sub-frame of the machine.
Figure 3:
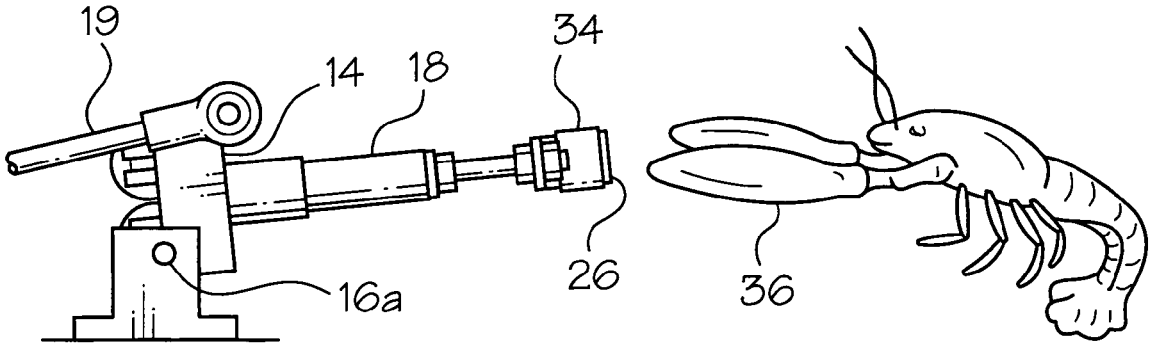
FIG. 3 is a side view of the sub-frame as in FIG. 2 in a band application position.
Figure 4:
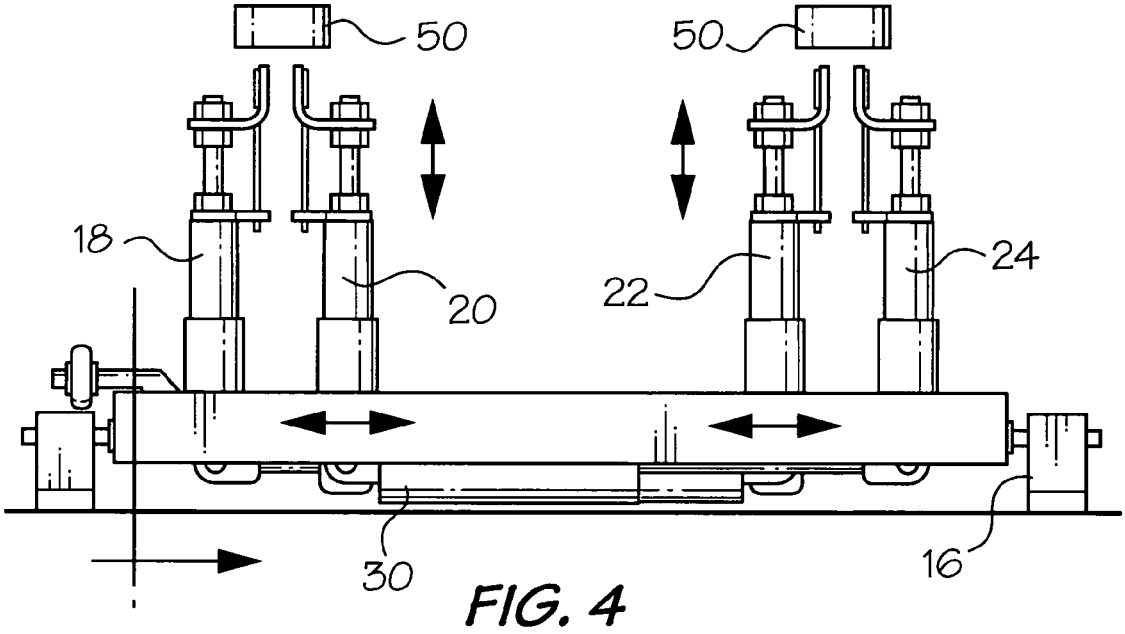
FIG. 4 is a front view of the finger sub-frame in the band reception position.

As also shown in FIGS. 2, 3 and 4, a sub-frame 14 is mounted on the lowest shelf 5. The sub-frame is pivotally mounted on two supports 16, 16*a*. A pneumatic cylinder 19 is connected to the floor 5 of the frame 2 and to the sub-frame 14 in a manner to effect, when the cylinder 19 is actuated, a pivotal movement of the sub-frame relative to the supports 16, 16*a* as will be shown below in more detail in conjunction with FIGS. 2 and 3.

Two pairs of fingers 18, 20 and 22, 24, are mounted to the sub-frame so as to extend perpendicularly from a longitudinal axis A of the sub-frame. In each pair, the fingers do not have to be disposed exactly perpendicularly to the axis A, however, it is preferable that at least their free ends or tips 26 (FIG. 2) extend essentially parallel to each other for the purpose of holding an elastic band thereon.

Figure 5:
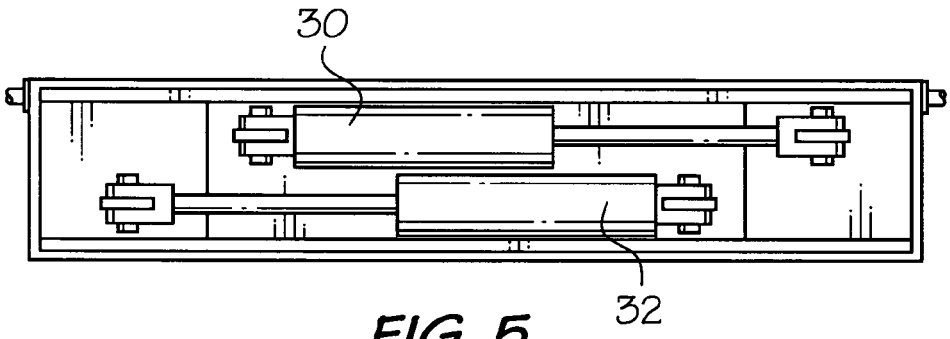
FIG. 5 is a bottom view of the sub-frame of FIG. 4 showing finger actuators.
Figure 6:
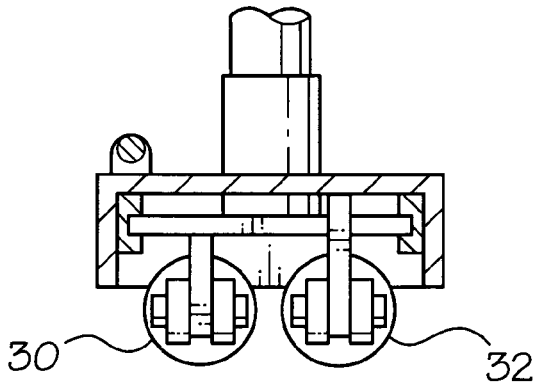
FIG. 6 is a cross-sectional view of FIG. 5.

As illustrated in FIGS. 2, 4 and 5, each pair of fingers has a stationary finger 18, 24 and a movable finger 20, 22 and the sub-frame 14 has two cutouts 28 to enable a displacement of the movable fingers along an axis ("first axis") that is substantially parallel to the axis A of the sub-frame. The displacement is effected by means of two pneumatic cylinders 30, 32 mounted beneath the sub-frame 14 (FIG. 5 and FIG. 6). The amount of the displacement is selected by the dimension of the cutouts to suit a predetermined length to which a rubber band 34 should be stretched to accommodate a claw 36 of a lobster.

FIG. 1 and FIG. 2 show the two pairs of fingers 18, 20 and 22, 24 in a vertical, band reception position. As will be seen in FIG. 1, when in this position and brought together, the fingers are positioned directly below the respective cutters 12. When the tube is fed from the spools 7, 7*a* by the grippers 11 through the cutters, the end of the tube can cover and encompass the tips of the fingers. Two pairs of grippers are provided. The upper pair (FIG. 1) is mounted on the frame 1 for gripping and releasing the tube 8 in a horizontal plane as indicated by the upper horizontal arrows. The lower pair is mounted to a pneumatic cylinder 17 for a displacement in a vertical direction (as shown by the vertical arrows) and for gripping and releasing the tube 8 in a horizontal plane as indicated by the lower horizontal arrows.

When subsequently a band is cut from the tubular stock 8 by the cutters 12, the band rests on a respective pair of adjacent finger tips 26.

The sub-frame can now be brought to a band application position which is a horizontal position of the fingers (and their longitudinal axes) shown in FIG. 3. In this position of the fingers, the cylinders 30, 32 are actuated to cause the movable fingers 20, 22 to spread, or move away from their respective stationary fingers. The actuation of the movable fingers can be controlled, in a manner known to those skilled in the mechanics, so that the spreading motion starts as soon as a band is placed on the fingers due to the action of the grippers 11 and the cutters 12 as explained in the preceding paragraph.

It is noted that the term "stationary" only denotes the position of the stationary fingers 18, 24 relative to the axis A, or the direction of spreading. The stationary fingers are pivotable along with the sub-frame 14.

Figure 7:
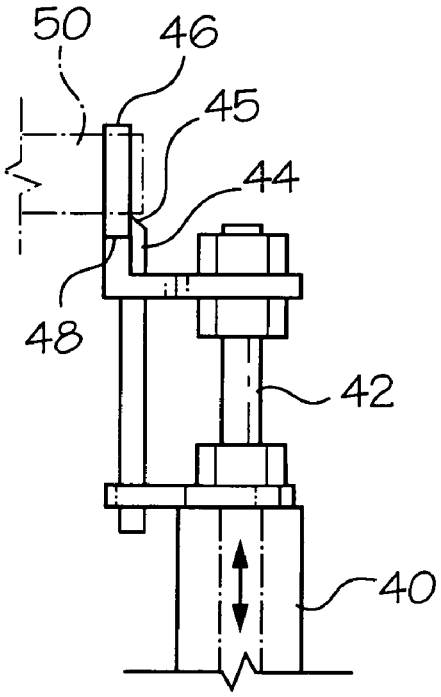
FIG. 7 is a partial side view of one of the fingers of the machine in a band-holding position.

In an embodiment of the invention illustrated herein, the design of the fingers is such as to facilitate the application of the band onto a desired object, e.g. a lobster claw. As illustrated in FIG. 7, each of a pair of fingers 18, 20 is formed by a pneumatic cylinder 40 with an extendable/retractable shank 42. A pusher pin 44 with a slanted tip 45 is fixed to the casing of each cylinder 40, and a stem 46 is fixed to the end of the shank 42. As shown specifically in FIG. 7 a representing top view of the pin 44 and the stem 46, the latter has a larger lateral dimension than the pin 44, and features shoulders 48 so that a rubber band, shown in phantom lines 50 in FIG. 7 and 7*a*, rests on the shoulders 48 when the fingers are in the band reception (vertical) position as shown in FIG. 1.

Figure 7A:
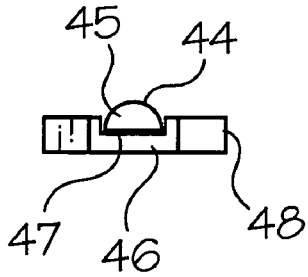
FIG. 7*a* shows a cross-sectional view of a band stretching member and a band push-off member of the finger of FIG. 7.

As seen in FIG. 7*a*, the stem 46 has a recess 47 to accommodate the pin 44. This is advantageous for the step of disengaging a band from the fingers as will be explained below.

Figure 8:
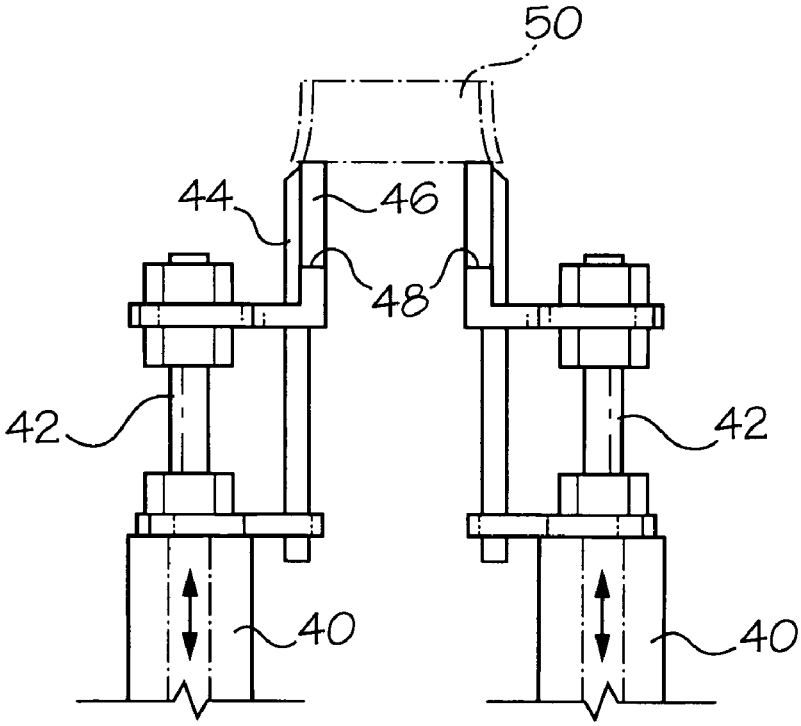
FIG. 8 is a partial side view of a pair of the fingers in an extended, band-disengaging position.

Referring now also to FIG. 8, the actuation of the cylinder 40 causes the shank 42 to move downward along the direction indicated by the arrows in FIG. 7. As a result, the pusher 46 slides downward relative to the pin 44. This causes the slanted shoulder 45 of the pin 44 to engage the band 50, wedging under the periphery of the band due to the recessed shape of the shank 46, and push it towards the tip of the stem 46. As shown in FIG. 8, this causes the band to slip off the respective stems of a pair of fingers. If an object is present inside the band at this point, the band will snap around it and closely encircle the object which can now be removed from the machine.

Figure 9:
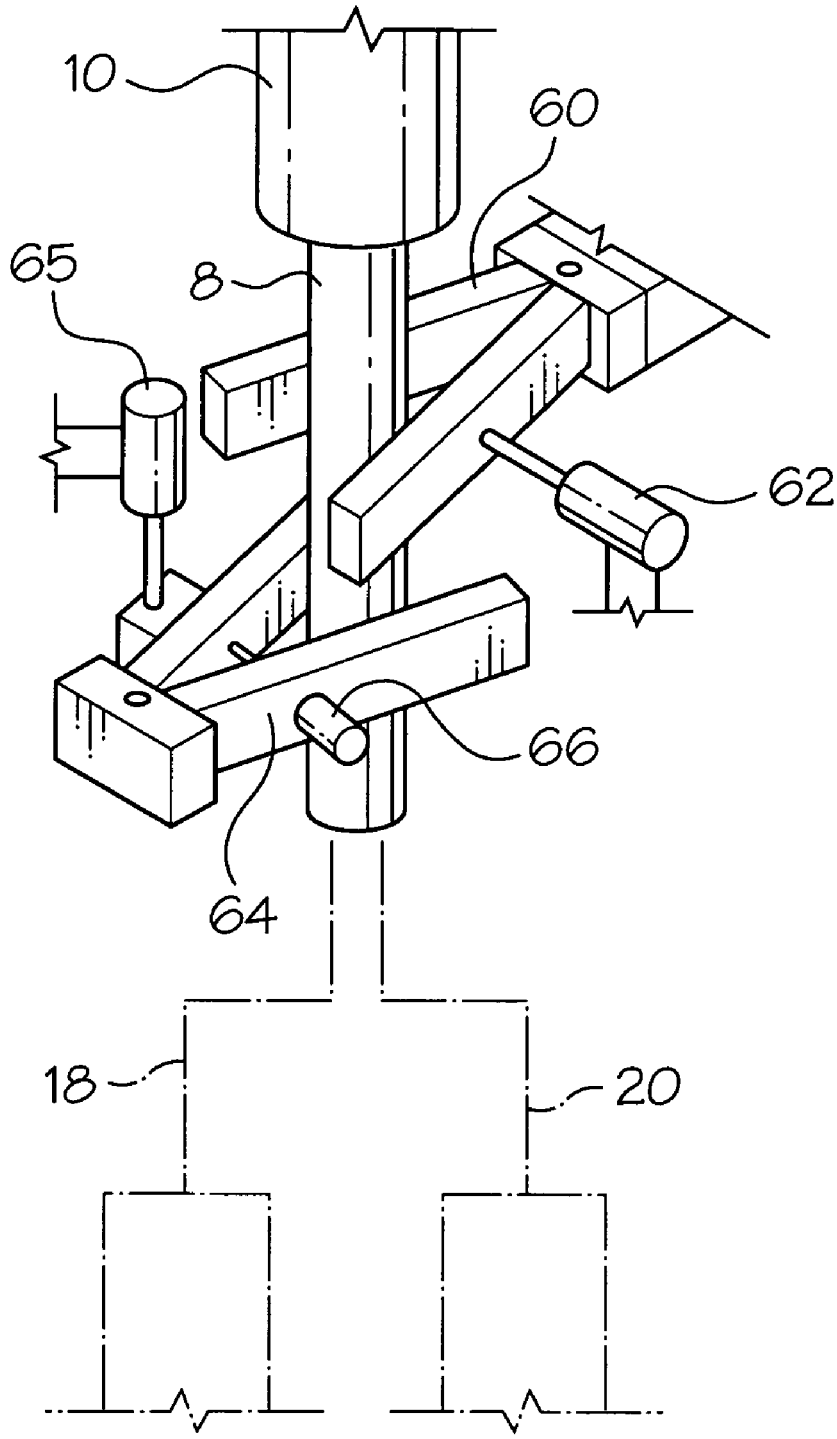
FIG. 9 is a perspective view of the grippers of the machine of the invention.

Turning now to FIG. 9, the grippers are shown schematically in more detail than in FIG. 1. The upper gripper jaw 60 is mounted on the frame so that its arms are operable to grip and release the tube 8 by an pneumatic cylinder 62 in a horizontal plane. The gripper jaw 60 is not movable in a vertical direction. The lower gripper jaw 64 has also two arms which are operable to grip and release the tube 8 beneath the upper gripper. However, the lower gripper jaw 64 is mounted to a pneumatic cylinder 65 which is mounted to the frame 1. The pneumatic cylinder 66 is operable to extend and retract its shank and the lower gripper jaw 64 in a vertical direction. A guide (not shown) may be provided to maintain a predetermined position of the gripper 64 relative to the tube 8. The gripping and releasing movement of the arms of the lower gripper is controlled via a pneumatic cylinder 66 which moves in a vertical direction along with the gripper jaw 64 when the cylinder 65 is actuated.

In operation, the sequence of steps of the banding procedure can be controlled manually or through a control system to execute the steps automatically. For simplicity, the control system will not be described herein.

The rubber band stock 8 is fed from the spools 7, 7*a* through the respective feeders 10 into the feeders 11 (FIG. 1). The pneumatic cylinder 19 is activated so that the sub-frame 14 is brought to the vertical position as shown in FIG. 1. The upper gripper jaw 60 is open, the lower jaw 64 is closed and the actuator 65 is operated to bring the jaw 64 down by a sufficient distance to feed the tube 8 through the cutters 12 and to engage the tips of the fingers 18, 20. The actuators (pneumatic cylinders) 13 of the cutters 12 are activated and a band is cut from the tube 8. Thereafter, the pneumatic cylinder 19 and pneumatic cylinders 30, 32 are actuated simultaneously (or with a delay). This has the effect of the sub-frame 14 moving to a horizontal position (FIG. 3) and the movable fingers moving away from the stationary fingers thereby spreading respective rubber bands 50. The object, e.g. a lobster claw, is now inserted into the loop of the stretched band 50 and the pneumatic cylinders 40 are actuated. As a result, the pins 44 push the bands 50 from the respective shanks 46 and the bands contract to encompass tightly the lobster claw(s) 36.

To close the cycle, the cylinder 19 is activated to bring the fingers 18, 20, 22, 24 to the band-receiving vertical position of FIG. 1. The upper gripper jaw 60 is operated to grip the tube 8, the lower jaw 64 is operated to open and the cylinder 65 is actuated to lift the lower jaw 64 by a distance equivalent to the desired width of the band 50. The cylinder 66 is now operated to close the jaw 64, cylinder 62 is operated to open the upper jaw 60 and the cylinder 65 is actuated to lower the lower jaw by the same distance as the width of the band. This causes the end of the tube 8 to slip over the upturned free ends of the fingers 18, 20, 22, 24 (as shown in FIG. 9) and the cycle can be repeated. Thus, the pair of gripper jaws is operable in tandem to secure a correct controllable position of the end of the tube 8 in the cutters 12.

It will be noted that in operation, both gripper jaws 60, 64 are never released at the same time to prevent a pullback of the tube 8 by a spurious movement of the spool. FIG. 9 illustrates such position for clarity only.

It will be recognized by those skilled in the art that the above description and illustration are not intended as a detailed instruction manual and only serve to elucidate the concepts of the invention. For clarity, the control system, i.e. a control circuit, control board, compressors, pneumatic hoses, push-buttons etc. have not been illustrated.

While a specific embodiment has been illustrated, the invention is not intended to be limited to the embodiment and is to be defined solely by the appended claims.

We claim:

1. A method for applying an elastic band on an object, the method comprising the steps of:

providing a source of elastic bands, providing at least one pair of fingers, each finger comprising a band stretching member;

a band push-off member mounted adjacent to the band stretching member, and a push-off member actuator for moving the push-off member parallel to the longitudinal axis of the respective finger, whereby said fingers are movable away from and toward each other and movable between a band reception position and a band application position, placing a band on said band stretching member in a band reception position, moving the fingers of the pair away from each other to spread and to stretch the band, moving the spread fingers to the band application position, positioning an object to be banded within a perimeter of the stretched band, and activating the push-off member actuator to release the band from the band stretching member onto the object.

2. The method according to claim 1, wherein the step of providing a source of elastic bands comprises providing a tubular stock of band material, advancing the stock controllably to cutting means, and cutting a band from the tubular stock while the fingers are at the band reception position.

3. A machine for applying an elastic band to an object, the machine comprising a frame, at least one pair of fingers mounted on the frame and extending thereof side-by side for receiving an elastic band thereon;

a first actuator displacing the fingers of the pair relative to each other between a band spreading position and a retracted position, a second actuator displacing the pair of fingers between a band reception position and a band application position, and band disengagement means for disengaging the band from the pair of fingers in the band application position.

4. A machine for applying an elastic band on an object, the machine comprising:

a frame, a sub-frame mounted to said frame and comprising at least one pair of fingers mounted side-by-side on said sub-frame and having free ends, the fingers movable towards and away from each other along a first axis and their free ends extending transversely to the first axis, spreading means operatively associated with the fingers for selectively moving the fingers towards or away from each other along the first axis, and means for displacing the sub-frame with the fingers between a band reception position and band application position, wherein each finger in the pair comprises a band stretching member;

a band push-off member mounted adjacent to the band stretching member and slidable relative to the stretching member, and push-off means for moving the push-off member parallel to a longitudinal axis of the respective finger.

5. The machine according to claim 4 wherein the means for displacing are means for pivoting the sub-frame about the first axis.

6. The machine according to claim 5, further comprising a band dispensing mechanism comprising a supply of elastic bands, the supply disposed so that in the band reception position, the free ends of the fingers are adjacent to each other and disposed to receive an elastic band from the supply.

7. The machine according to claim 6, further comprising advancing means for controllable advancing of said supply of elastic bands.

8. The machine according to claim 7, wherein said advancing means is a pair of grippers operable in tandem.

9. The machine according to claim 4, further comprising a band dispensing mechanism comprising a supply of elastic bands, the supply disposed so that in the band reception position, the free ends of the fingers are adjacent to each other and disposed to receive an elastic band from the supply.

10. The machine according to claim 9, further comprising advancing means for controllable advancing of said supply of elastic bands.

11. The machine according to claim 10, wherein said advancing means is a pair of grippers operable in tandem.

12. The machine according to claim 4, wherein said push-off means is a pneumatic cylinder associated with a respective push-off member.

13. The machine according to claim 12, wherein the push-off member is slidable in a recess which is formed in a body of the band stretching member.

14. The machine according to claim 4, wherein the push-off member is slidable in a recess which is formed in a body of the band stretching member.

* * * * *